United States Patent [19]

Radtke

[11] Patent Number: 4,795,045

[45] Date of Patent: Jan. 3, 1989

[54] CLOSURE FOR CONTAINERS

[76] Inventor: Charles S. Radtke, 37 Beech St., Little Ferry, N.J. 07643

[21] Appl. No.: 152,535

[22] Filed: Feb. 5, 1988

[51] Int. Cl.[4] ..... B65D 41/12

[52] U.S. Cl. ..... 215/325; 220/310

[58] Field of Search ..... 215/324, 325, 327; 220/309, 310

[56] References Cited

U.S. PATENT DOCUMENTS

| | | | |
|---|---|---|---|
| 582,762 | 5/1897 | Painter | 215/327 |
| 3,104,773 | 9/1963 | Podesta et al. | 215/327 |
| 4,318,493 | 3/1982 | Jacobsen | 220/310 X |
| 4,561,555 | 12/1985 | Miller | 215/327 X |

FOREIGN PATENT DOCUMENTS

| | | | |
|---|---|---|---|
| 759417 | 10/1956 | United Kingdom | 215/327 |

*Primary Examiner*—Donald F. Norton

*Attorney, Agent, or Firm*—Ronald G. Goebel; Bruce M. Collins

[57] ABSTRACT

The present invention provides a closure for a container, preferably a plastic aerosol container on which there is provided a specially designed neck. A metal cup having vent slots is fittable on the container top and neck. The cup has formed at its periphery an inwardly curled tuck and a rounded top portion which fits over a rounded annular shoulder on the neck. The radius of the rounded annular shoulder of the neck is larger than the radius of the rounded top portion of the cup. The neck further includes a tuck support member having a horizontal ledge. A tuck pocket is formed between the annular shoulder and the tuck support member to accomodate the tuck in the cup. Sealing of the cup to the container occurs at the annular shoulder of the neck by pressure of a pressure ring in concert with a pilot of a closure die on the cup top portion. Because of the difference in radii between the rounded annular shoulder and the rounded top portion of the cup, the cup is pressure sealed to the annular shoulder at at least two points on the sides of the annular shoulder. The tuck of the cup is inserted in the tuck pocket and the ledge of the tuck support member prevents the tuck from unravelling during sealing.

11 Claims, 5 Drawing Sheets

CLOSURE FOR CONTAINERS

BACKGROUND OF THE INVENTION

This invention is concerned with a closure assembly for a container, particularly a plastic container and a method for forming said closure.

In the past aerosol containers have been fabricated from metals. However, such metal containers suffer from certain disadvantages. They are subject to rusting and denting and are relatively heavy. If bursting or exploding of the container occurs due to excessive pressures there is the danger of injury.

More recently the aerosol industry has moved towards the use of plastic aerosol containers made from materials such as polyethylene terephthalate which offers the advantages of freedom from rusting and denting, light weight, amenability to graphics for purposes of trade dress and good tactile properties, among others. However, one of the problems associated with the commercial production of these aerosol containers is the provision of an effective closure. Metal mounting cups have been used which fit onto the container opening. In one method of closure the cup is clinched externally around the neck of the container by segmented metal jaws such as those used to seal glass bottles. In another method, the skirt of the metal cup is tucked under a bead on the container neck by rotating the container or the tool used to form the seal. The cups employed in the clinched jaw method are subject to leakage between the clinched portions and in the case of both the clinched jaw and roating methods the cup cannot easily be removed if, for example, the plastic container is required to be recycled separately from the cup.

Another type of closure used on metal cans and containers is the so-called double seam closure. In this type of closure the top of the container body terminates in a flange which fits within a curl or tuck on the peripheral edge of the mounting cup. In forming the double seam the flange is interfolded with the curl in a rotating method involving the tool or the container as discussed above to hermetically seal and close the container as the double seam is formed. In addition a small amount of sealing compound is positioned along the interior wall of the curl to provide a hermetic seal in forming the double seam. Such double seam closures are not effective on plastic containers because the plastic cannot be readily interfolded with the curl of the metal mounting cup and deformation of the container top occurs. Further, neither the segmented jaw method nor the rotating method allow charging of the container under the mounting cup. Such charging can only be accomplished through the aerosol container valve.

The present invention, on the other hand, provides an effective closure for a plastic container which employs a metal mounting cup to seal the container but is not sealed with segmented jaws or by the rotation method. The cup can more easily be removed without damage to the container for recycling purposes than in the case of clinched closures or double seam closures. In addition the invention permits charging of the aerosol container under the cup and therefore lends itself to a retrofit of existing under the cup charging equipment used to charge metal containers.

SUMMARY OF THE INVENTION

In brief, the present invention provides a closure for a container, preferably a plastic aerosol container, on which there is provided a specially designed neck. A metal mounting cup is fittable on the container top and neck. The cup has formed at its periphery an inwardly curled tuck and a rounded top portion which fits over a rounded annular shoulder on the neck. The radius of the rounded annular shoulder of the neck is larger than the radius of the rounded top portion of the cup. The neck further includes a tuck support member having a horizontal ledge. A tuck pocket is formed between the annular shoulder and the tuck support member to accomodate the tuck in the cup. Sealing of the cup to the container occurs at the annular shoulder of the neck by pressure of a pressure ring in concert with a pilot of a closure die on the cup top portion. Because of the difference in radii between the rounded annular shoulder and the rounded top portion of the cup, the cup is pressure sealed to the annular shoulder at at least two points on the sides of the annular shoulder. The tuck of the cup is inserted in the tuck pocket and the ledge of the tuck support member prevents the tuck from unravelling during sealing at the shoulder and acts as an anchor for the seal. The annular shoulder may also have formed in its underside an indentation concaved inwardly to prevent release of the edge of the tuck. The cup is also equipped with vent slots spaced about its periphery to allow release of the excessive pressures in the container.

The closure represents a departure from and an improvement over the previously mentioned double seam and segmented jaw methods of closure. The seal is readily adaptable to plastic containers and provides an effective seal without deformation of the container neck. The cup can more easily be removed from the container than in the case of prior closures to allow separate recycling of cup and container. Finally, the closure method permits under the cup charging of the aerosol container using existing equipment.

DETAILED DESCRIPTION OF THE PREFERRED EMBODIMENTS

Figure 1:
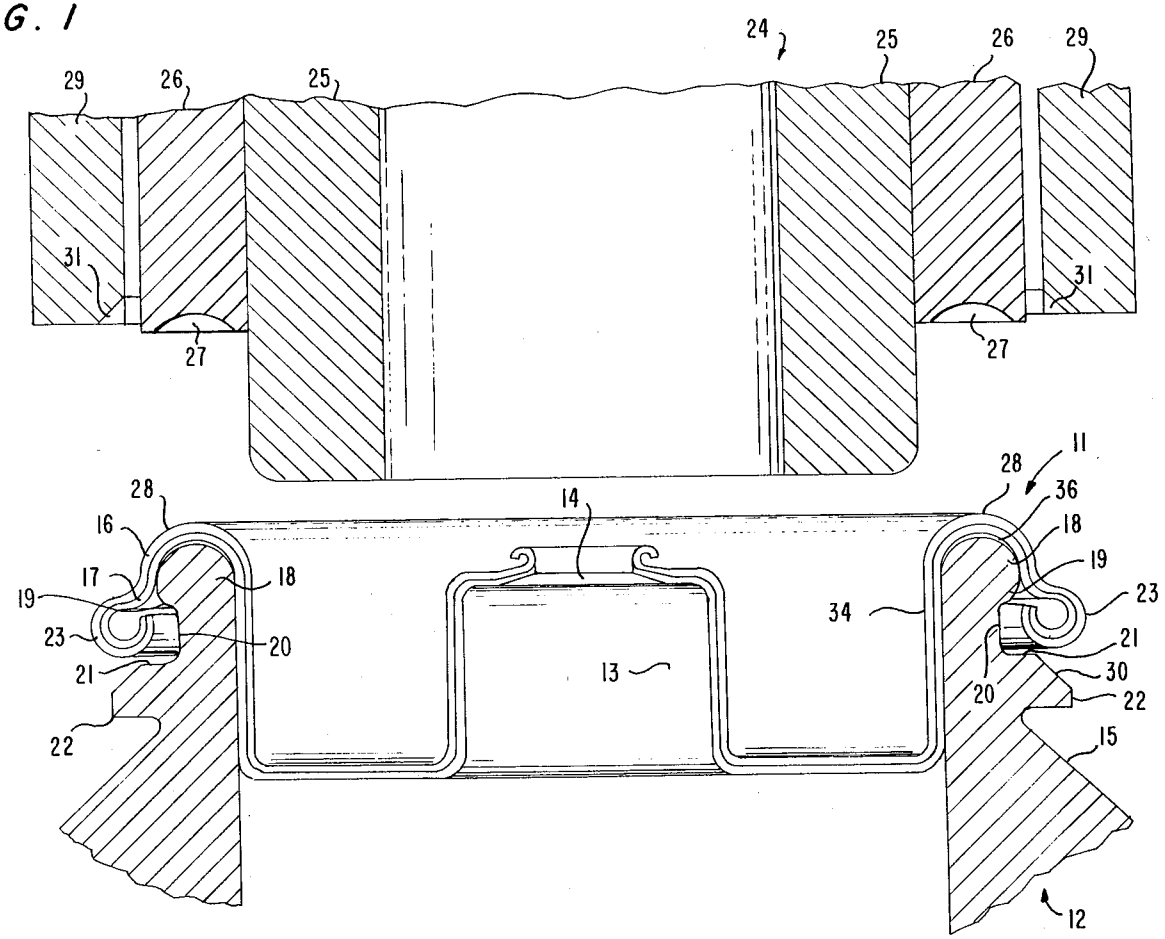
FIG. 1 is a cross-sectional view of an aerosol container and die closure showing the mounting cup in position on the container prior to sealing.
Figure 2:
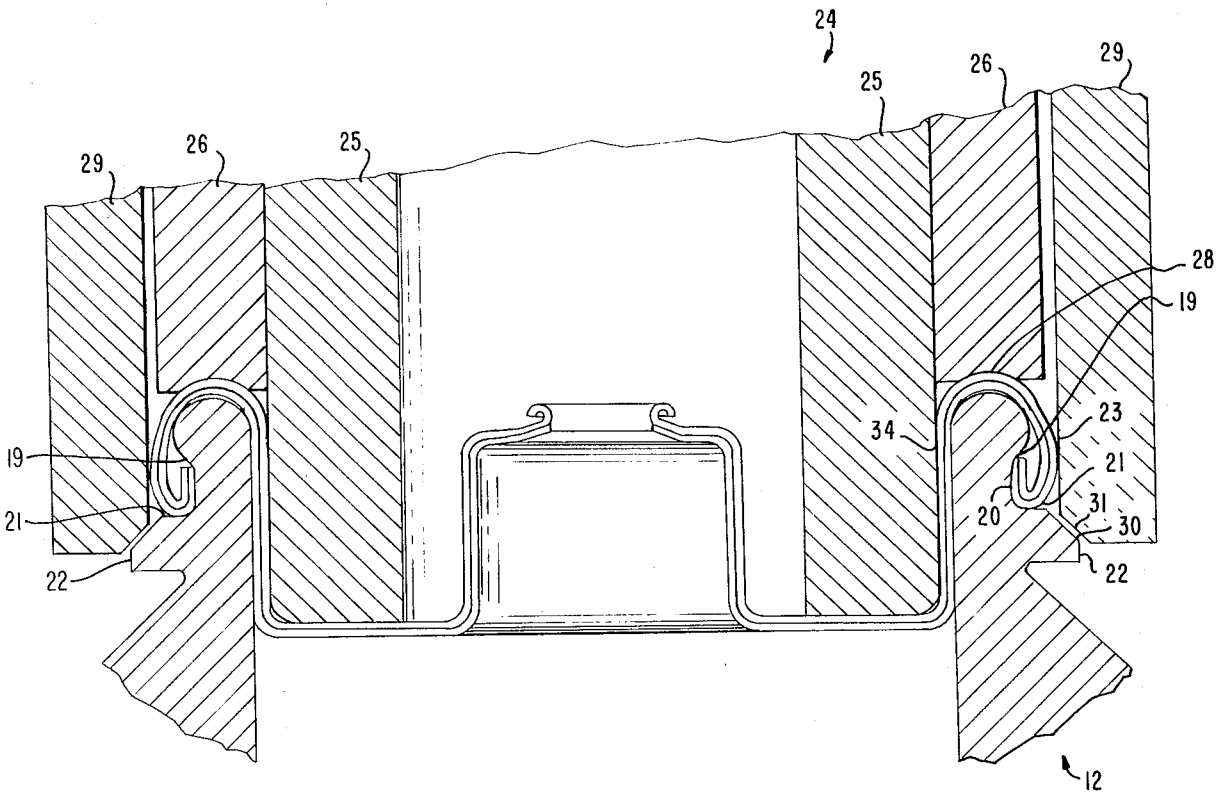
FIG. 2 shows the cup sealed to the container by the die closure shown in FIG. 1.

Referring to FIGS. 1 and 2 there is shown generally a mounting cup 11 for a plastic container such as a plastic aerosol container, a top section of which is shown generally by 12. The container top has a central raised fill section 13 having opening 14 through which the stem of the aerosol spray valve mechanism is inserted (not shown). The container has a specially designed plastic neck 15 which will be described in more detail hereafter. The cup 11 is an annular member which matches or registers with the contour of the container top and neck. The cup has formed at its periphery a curled tuck 23 turned inwardly. The cup is preferably a laminate consisting of a top layer 16 of a metal such as tin-coated steel and a lower layer 17 of a plastic gasketing material such as polypropylene. Generally the top layer 16 has a thickness of about 0.01" and the lower layer 17 has a thickness of about 0.008".

The cup may also be used without a gasketing material although it is preferable to provide gasketing. A laminate of gasketing material as described above is advantageous. However, other gasketing systems such as a flowed-in-gasket, washer, or sleeve-type gasket may be employed with the cup.

Figure 5:
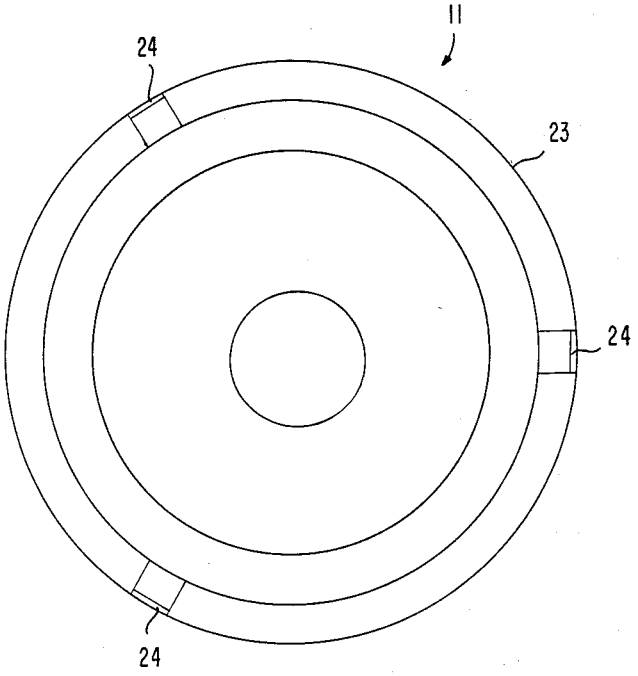
FIG. 5 shows a top view of the mounting cup.

A top view of the cup is shown in FIG. 5. The cup is provided with vent slots 24 spaced 120° apart to allow venting of the container after the cup is sealed to the container should excessive pressures develop.

Figure 3:
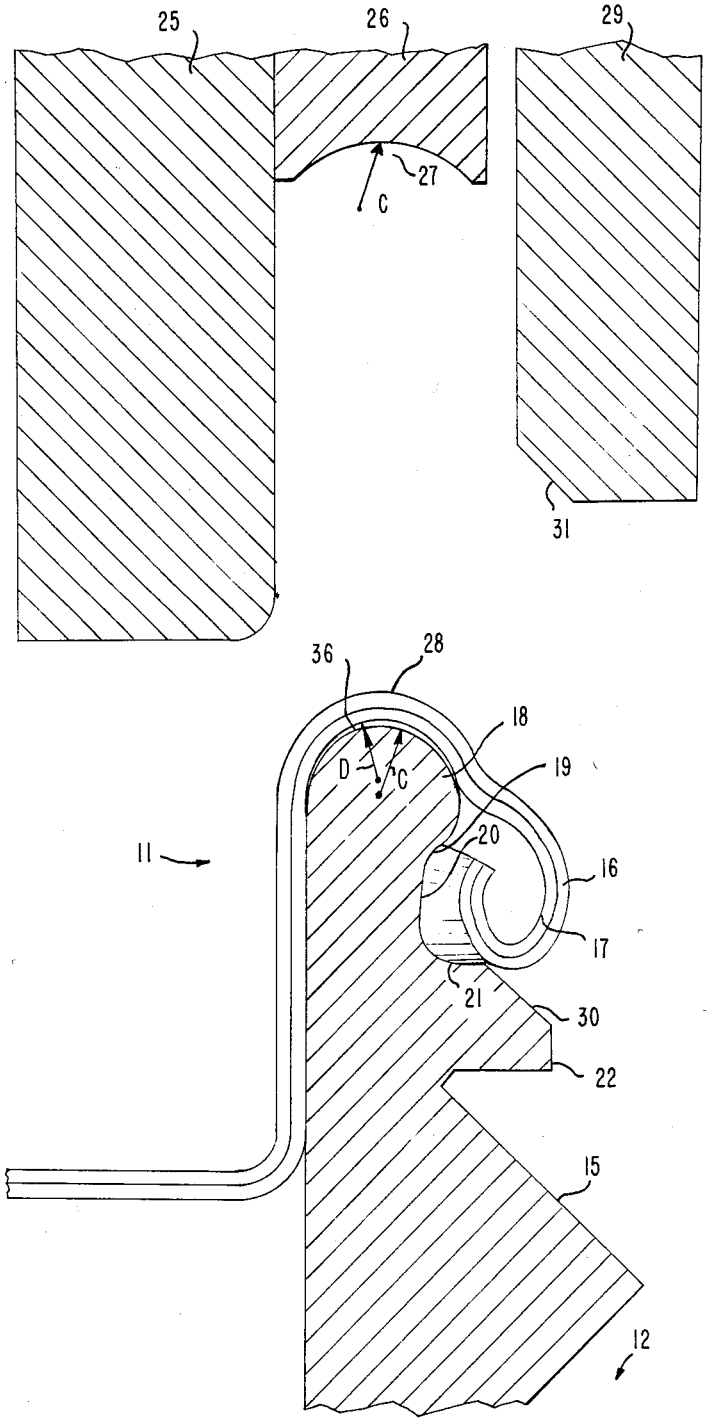
FIG. 3 is an enlarged view of the annular shoulder of the neck of the container and the cup end section prior to sealing.
Figure 4:
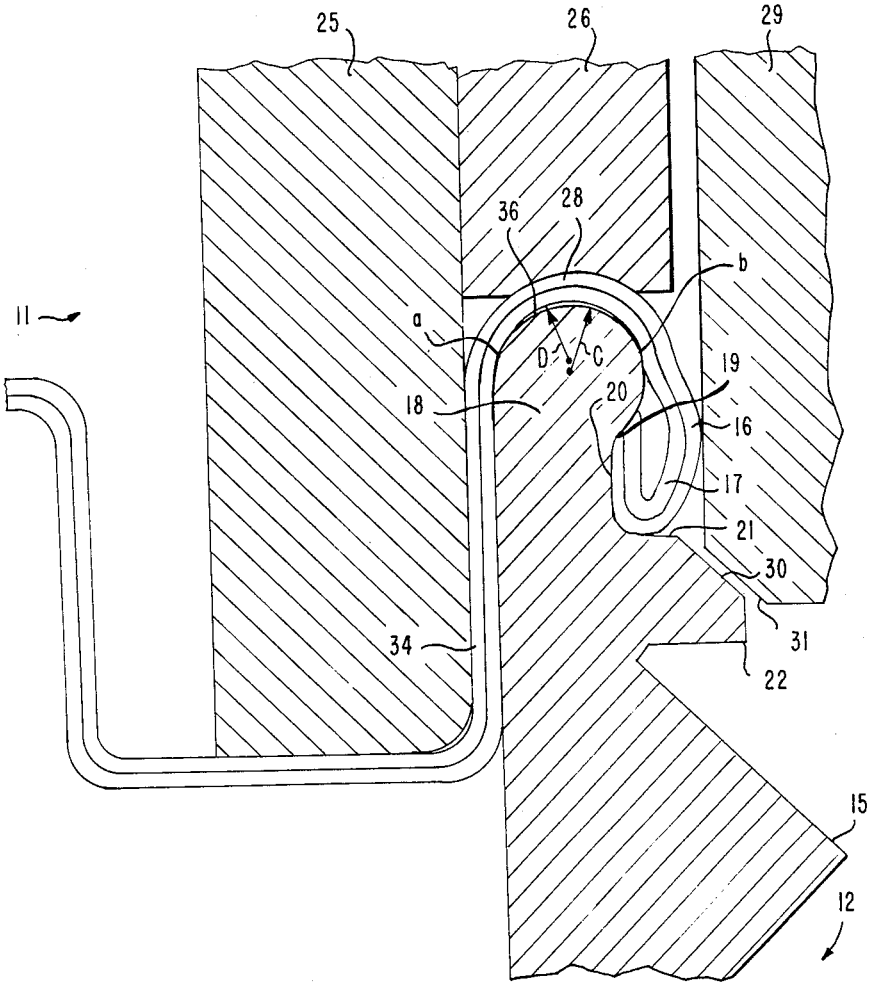
FIG. 4 is an enlarged view of the annular shoulder of the neck of the container and the cup end section after sealing.

The container neck 15 employs a unique construction important to the invention. The top portion of the neck is provided with a rounded annular shoulder 18 having radius C as shown in FIGS. 3 and 4. The top portion 28 of the cup 11 which fits over the annular shoulder of the container neck has radius D as shown in FIG. 3. Radius C on the shoulder 18 is larger than radius D of the cup and a gap 36 is formed therebetween. The underside of annular shoulder 18 is concaved inwardly to form indentation 19. Located below the annular shoulder 18 is annular tuck support member 22 which protrudes outwardly from the container having horizontal ledge 21 and angular shoulder 30 extending outwardly from the ledge, the function of which will be described in more detail hereafter. A tuck pocket 20 is formed between the annular shoulder 18 and tuck support member 22.

A closure die shown generally by 24 is disposed above the cup. The die comprises a downwardly-biased pilot 25 and a pressure ring 26 having circular indentation 27 mounted adjacent pilot 25 and being movable downward therewith. The indentation has a radius C, that is a radius equivalent to the radius of the annular shoulder 18. Spaced apart slightly from the pressure ring is crimping ring 29 having angular inner face 31.

The cup is sealed to the container as follows referring to FIGS. 1 and 4. As the closure die moves downwardly the pilot 25 engages the cup inside 34 to orient the container to the closure die assembly. The pressure ring 26 engages rounded top portion 28 of the cup and presses it onto the annular shoulder 18 of the container neck. Because the radius C of the container neck is larger than the radius D of the cup top portion 28 the cup is pinched on the shoulder at points a and b as shown in FIG. 4 by virtue of the pressure from the pressure ring. This creates the seal of the cup to the container. The gap 36 formed between the top of the shoulder 18 and the underside of the cup between points a and b may be partially or totally occupied by the layer of gasketing material 17. The crimping ring moves downwardly until face 31 engages the shoulder 30 of the tuck support member 22. The crimping ring forces the tuck 23 of the cup to enter the pocket 20 with some deformation of the tuck. The bottom of the tuck rests on ledge 21 and the ledge prevents the tuck from unravelling while the seal is formed at points a and b of the annular shoulder and anchors the tuck. At the same time indentation 19 prevents the top of the tuck from sliding upwardly and outwardly to break the seal. No deformation of the container neck occurs.

It should be emphasized that, unlike containers with double-seams which depend on sealing at the tuck, the cup of the present invention is sealed on the top of the specially designed neck of the container, i.e. between points a and b, and the tuck of the cup deformed into the pocket 20 of the container neck prevents the seal from being broken. The vent slots 24, as previously mentioned, allow pressure release if excessive pressures develop in the container. Another important feature of the closure of the present invention is that the cup may be removed from the container more easily than in the case of segmented jaw or double seam closures by prying the tuck from the pocket and breaking the a/b seal. The plastic container may then be recycled separate from the metal cup. By virtue of the cup design and closure method for plastic aerosol containers according to the invention the limitation of having to fill through the aerosol valve is eliminated because the container can also be charged under the cup prior to the seal being formed. Under the cup filling must be accomplished in one poistion using an evacuation bell chamber above the container. The container can not be moved or rotated nor can apparatus external to the bell chamber be used to seal the cup to the container without loss of propellant. For this reason the rotation method or segmented jaw clinching will not permit under the cup charging. The present invention is not characterized by these limitations since rotation and external sealing apparatus are not employed.

Although the closure of the invention has particular application to plastic containers it may also be used on metal containers as well.

I claim:

1. A closure for a container having a top comprising in combination:

(a) a neck for said container having;
  (1) an annular rounded shoulder surrounding said top;
  (2) an annular tuck support member located below said annular rounded shoulder; and
  (3) a tuck pocket formed between said annular rounded shoulder and said tuck support member; and (b) a cup fitted over said container top and neck having;
  (1) a rounded top portion sealed on said annular rounded shoulder; and
  (2) an inwardly curled peripheral tuck fitted within said pocket;

the cross-section radius of said annular rounded shoulder being greater than the cross-section radius of said rounded top cup portion, said top portion thereby contacting said rounded shoulder at at least two points on each of said radii.

2. The closure of claim 1 wherein said annular tuck support member further comprises a horizontal ledge, said tuck resting on said ledge.

3. The closure of claim 1 wherein said annular rounded shoulder has an indentation located on the underside thereof, the edge of said tuck engaging said indentation.

4. The closure of claim 1 whrein said cup comprises a laminate consisting of a metal top layer and a bottom layer of gasketing material.

5. A closure for a container having a top comprising in combination;

(a) a neck for said container having;
  (1) an annular rounded shoulder surrounding said top having a first radius;

(2) an annular tuck support member located below said annular rounded shoulder having a horizontal ledge; and (3) a tuck pocket formed between said annular rounded shoulder and said tuck support member; and (b) a cup fitted over said container top and neck comprising;

(1) a rounded top portion having a second radius less than said first radius and being pressure sealed on said annular rounded shoulder at at least two points; and (2) an inwardly curled peripheral tuck fitted within said pocket and resting on said horizontal ledge.

6. The closure of claim 5 wherein said tuck support member further comprises an angular shoulder extending downwardly from said ledge.

7. The closure of claim 5 wherein said cup comprises a laminate consisting of a metal top layer and a bottom layer of gasketing material.

8. The closure of claim 5 wherein a gap is formed between said annular shoulder and said top portion of said cup, said gasketing layer at least partially filling said gap.

9. The closure of claim 5 wherein said container is comprised of plastic.

10. A closure for a container having an annular opening in which the terminus of the container about the opening defines, in cross-section, an arcuate shoulder, an inwardly concave indentation disposed on the outside of the container adjacent to and below the shoulder, and a shelf adjacent to and extending outwardly from the identation, said closure comprising:

a cup having a first, generally cylindrical shaped, inner portion of a diameter slightly less than the inside diameter of said container opening, a second curved sealing portion extending outwardly radially from the upper terminus of said cylindrical inner portion, said second curved sealing portion having a cross-section radius less than the cross-section radius of said container shoulder and being operable upon placement on said container shoulder to contact the shoulder at at least two points, and a third downwardly disposed, inwardly curved, peripheral tuck operable under downwardly applied pressure exerted on said cup to engage said container shelf and curl into said container indentation in locking relationship.

11. A closure according to claim 10 in which a plurality of radially disposed slots are disposed in said third peripheral tuck portion of said cup.

* * * * *